US007975417B2

(12) United States Patent
Duplessis et al.

(10) Patent No.: US 7,975,417 B2
(45) Date of Patent: Jul. 12, 2011

(54) SYSTEM FOR JOINING A BARREL TO THE RECEIVER OF A BOLT ACTION RIFLE

(75) Inventors: Ronald Duplessis, Baton Rouge, LA (US); Kenneth W. Sedon, Kalispell, MT (US)

(73) Assignee: Ronald Duplessis, Baton Rouge, LA (US)

( * ) Notice: Subject to any disclaimer, the term of this patent is extended or adjusted under 35 U.S.C. 154(b) by 177 days.

(21) Appl. No.: 12/353,142

(22) Filed: Jan. 13, 2009

(65) Prior Publication Data

US 2010/0175290 A1 Jul. 15, 2010

(51) Int. Cl.
*F41A 3/12* (2006.01)

(52) U.S. Cl. ..... 42/16; 42/75.02

(58) Field of Classification Search ..... 42/16, 75.02
See application file for complete search history.

(56) References Cited

U.S. PATENT DOCUMENTS

| | | | | | |
|---|---|---|---|---|---|
| 2,423,854 | A | | 7/1947 | Simpson | |
| 3,183,617 | A | | 5/1965 | Ruger | |
| 3,274,724 | A | * | 9/1966 | Brandt | 42/16 |
| 3,330,061 | A | * | 7/1967 | Koon, Jr. | 42/16 |
| 3,341,963 | A | * | 9/1967 | Seiderman | 42/16 |
| 3,494,216 | A | * | 2/1970 | Haskins | 42/16 |
| 3,708,841 | A | | 1/1973 | Quinney | |
| 3,742,638 | A | * | 7/1973 | Archer | 42/25 |
| 3,755,947 | A | * | 9/1973 | Koon, Jr. | 42/16 |
| 3,877,167 | A | | 4/1975 | Keppeler | |
| 3,979,849 | A | * | 9/1976 | Haskins | 42/16 |
| 4,402,152 | A | * | 9/1983 | Casull | 42/16 |
| 4,547,988 | A | * | 10/1985 | Nilsson | 42/16 |
| 4,791,748 | A | * | 12/1988 | Leskinen | 42/75.02 |
| 5,020,260 | A | | 6/1991 | Houghton | |
| 5,228,887 | A | | 7/1993 | Mayer | |
| 5,410,834 | A | | 5/1995 | Benton | |
| 5,907,919 | A | | 6/1999 | Keeney | |
| 5,987,797 | A | | 11/1999 | Dustin | |
| 6,205,696 | B1 | | 3/2001 | Bilgeri | |
| 6,609,323 | B1 | | 8/2003 | Donnelly | |
| 7,313,883 | B2 | | 1/2008 | Leitner-Wise | |
| 2001/0029687 | A1 | * | 10/2001 | Hashman | 42/16 |
| 2005/0188591 | A1 | | 9/2005 | Stone | |
| 2007/0186458 | A1 | | 8/2007 | Wait | |
| 2008/0168695 | A1 | | 7/2008 | Nakayama | |

OTHER PUBLICATIONS

"Operating and Safety Instructions, Sauer 202" (Publication Date—unknown, but prior to Jan. 13, 2008); pp. 1-34; Publisher: J.P. Sauer & Sohn, Germany.

* cited by examiner

*Primary Examiner* — Troy Chambers
(74) *Attorney, Agent, or Firm* — Roy Kiesel Ford Doody & Thurmon, APLC

(57) ABSTRACT

An improved action for a bolt action rifle. The action includes a receiver containing a bolt; the bolt having two to three locking lugs surrounding a bolt face; and a threaded insert that joins the rifle barrel to the receiver. The insert also includes a series of locking lugs that mate with the locking lugs on the bolt. The position of the insert lugs relative to the barrel will position the bolt face relative to the barrel's chamber when the bolt is closed. Thus, the insert and barrel can properly set the rifle's headspace. The insert and receiver are preferably each provided with a locking lug, that serve to align the axes of the insert and receiver. The threads of the insert and the barrel are co-axial which serves to align the axes of the insert and barrel. Thus, assembled, the receiver, insert and barrel will be substantially co-axial.

18 Claims, 14 Drawing Sheets

1
2
4
3
10
7
27
2B 27
4
3
10
7

7
10
3
4
2
29
2D 7
10
3
4
2
27

4
60°
3
30

10
10b
12
15i
22i
19
18
10r
22i 10
13i
11
20i
10r
11
18
12
17i
17i
16i
19
20i
15i 10r
17i
18
16i
10b 19
15i
10
4E
10r
25
11

20i
11
22i
4E
18
17i
19
15i
22i
16i
10
10b
26
15i
22i
24i
25
19
11
22i

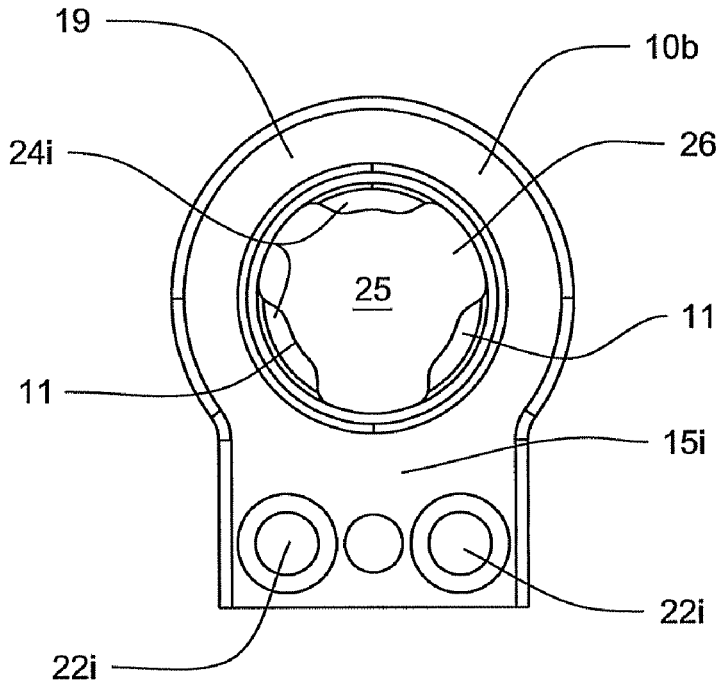
Fig 11A
Fig 11B
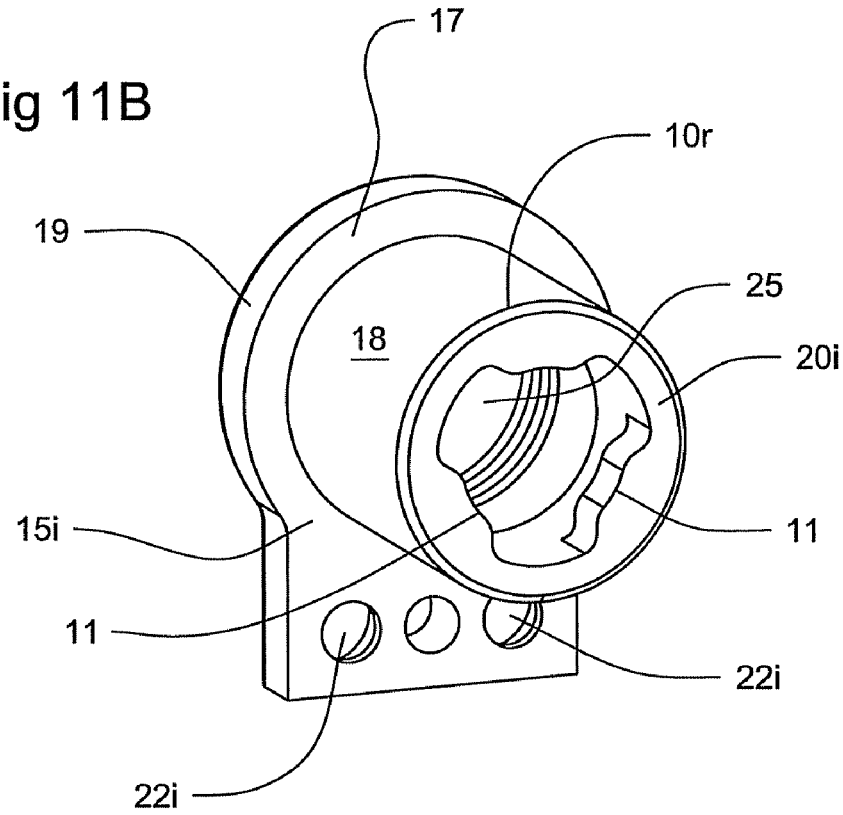

SYSTEM FOR JOINING A BARREL TO THE RECEIVER OF A BOLT ACTION RIFLE

BACKGROUND OF THE INVENTION

1. Field of the Invention

The invention relates to rifle actions in general and bolt actions in particular.

2. Prior Art

In a bolt action rifle, the barrel is typically threaded into the receiver. The barrel includes the chamber, which is that portion of the barrel that holds the round immediately prior to firing. The rough dimensions of the chamber are formed prior to the barrel being threaded into the receiver. However, the final dimensions of the chamber are formed by hand in order to ensure that the headspace is proper.

Headspace is the distance from the face of the bolt to whatever surface in the chamber stops the round from advancing into the barrel. In a rimless cartridge, such as the .308, the headspace is the distance from the bolt face to the shoulder in the chamber. Stated more broadly, in a rimless cartridge, the headspace is a function of the distance from the face of the bolt to the chamber and of the chamber dimensions. Headspace in a rimless cartridge is illustrated in FIG. 1 as dimension X.

The acceptable tolerance for headspace in rifles is relatively narrow. In a .308, the acceptable headspace range is 1.6300 to 1.6340 inches. Thus, only 4 thousandths of an inch separate too little headspace from too much.

Very bad things can happen if the headspace is not within specification for the rifle. When the round is fired, the chamber is supposed to hold the casing in place so that the expanding (i.e., exploding) gases can be used to drive the bullet down the barrel. However, if there is too much headspace, those same gases can drive the casing back toward the bolt. This can result in failure of the casing, damage to the bolt, and in some cases, even catastrophic failure of the rifle. Excessive headspace can also result in the round advancing into the chamber so that the firing pin in the bolt cannot adequately impact the primer, with the result that the round fails to go off. Similarly, excessive headspace can allow the spent shell casing to slide forward into the chamber so that it cannot be extracted, which can preclude the rifle from being reloaded—an annoyance in the best of circumstances and a potentially deadly occurrence to the shooter in certain conditions, such as self-defense applications and dangerous game hunting.

Insufficient headspace can be a serious problem as well. If the bolt is closed on a round in a rifle with insufficient headspace, the bolt may be exerting tension on the casing in the chamber. This can lead to casing failure, resulting in the emission of the hot expanding powder gases into the chamber. This can result in catastrophic failure of the rifle and/or emission of hot gases directly into the face of the shooter. It can also result in a portion of a failed casing not extracting from the chamber.

Because of the close tolerances required of headspace and the significant risks associated with the operation of a rifle whose headspace is out of specification, the chambering of a rifle is typically finished by hand. First, the rifle will be rough chambered. Then, the gunsmith installing the barrel must manually ream the chamber, very slowly. He turns the reamer, measures the headspace, and then turns the reamer some more, until the headspace measurement is correct. This is a very time consuming process, and it is a substantial factor in the cost of rifle manufacturing as well as after market barrel replacement.

In view of the foregoing, a bolt action rifle meeting the following objectives is desired.

OBJECTS OF THE INVENTION

It is an object of the invention provide a method for joining a barrel to the receiver of a bolt action rifle.

It is another object of the invention to provide a method of joining a barrel to the receiver of a bolt action rifle without requiring manual boring of the chamber in the barrel.

It is still another object of the invention to provide a method of changing the barrel on a bolt action rifle without requiring manual boring of the chamber in the new barrel.

It is yet another object of the invention to provide a method of changing the barrel on a bolt action rifle without requiring extensive headspace adjustments to the chamber.

It is yet another object of the invention to provide a method of quickly and easily converting a bolt action rifle from one caliber to another.

It is still another object of the invention to provide a method of quickly and easily converting a bolt action rifle from one family of cartridges to another.

It is yet another object of the invention to provide a bolt action rifle whose bolt may be more easily rotated and thereby cocked by the shooter.

SUMMARY OF THE INVENTION

The invention relates to a bolt action rifle. The bolt action rifle includes a bolt, having a bolt head, which is preferably removable, a firing pin contained within the bolt, and a mainspring, the compression of which cocks the firing pin. The mainspring is compressed by rotating the bolt. In the preferred embodiment, the mainspring comprises a variable rate spring to facilitate cocking over shorter rotational distances. The bolt includes at least one row of two or three locking lugs positioned at the end of the bolt head. The bolt and bolt head are slidably positioned inside a receiver. The receiver has a longitudinal axis. An insert is positioned inside the receiver. The threaded insert also has a longitudinal axis. The threaded insert and the receiver are provided with recoil lugs positioned perpendicular to their respective longitudinal axes and configured to align the longitudinal axis of the receiver with the longitudinal axis of the insert when the recoil lugs meet. The insert may also be secured to the receiver, preferably using threaded apertures and screws to join the recoil lugs. The insert is further provided with internal threads into which the barrel may be threaded. The barrel also has a longitudinal axis. The threads of the insert and the threads of the barrel are preferably co-axial and thus are configured to align the longitudinal axis of the barrel with the longitudinal axis of the insert. The insert is also provided with locking lugs configured to engage the locking lugs of the bolt head when the bolt head is advanced toward the chamber of the rifle and rotated. When the barrel, insert, and receiver are joined and the locking lugs of the insert and bolt are engaged, the locking lugs of the insert are properly located relative to the chamber to position the bolt head the appropriate distance from the chamber to achieve proper headspacing for the cartridge. Thus, headspacing can be controlled by manufacturing the insert to match the barrel. Accordingly, barrels can be installed and changed without manually reaming the chamber to achieve the precise headspacing needed.

BRIEF DESCRIPTION OF THE DRAWINGS

FIG. 11A is an front end view of a preferred embodiment of the insert with the spaces configured to accommodate a bolt having lugs configured as shown in FIG. 10A.

FIG. 11B is a rear perspective view of the preferred embodiment of the insert shown in FIG. 11A.

DETAILED DESCRIPTION OF BEST MODE

Figure 1:
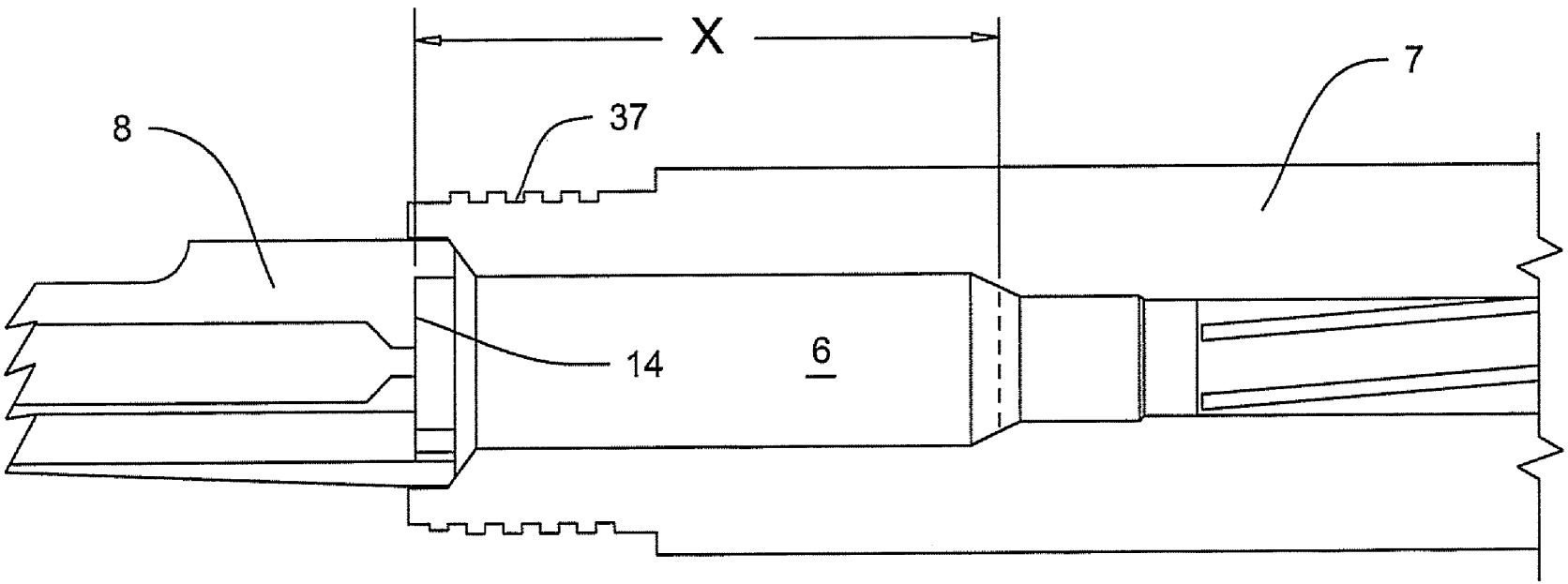
FIG. 1 is a cut-away side view of a prior art bolt action rifle illustrating how headspacing is measured.
Figures 2A, 2B:
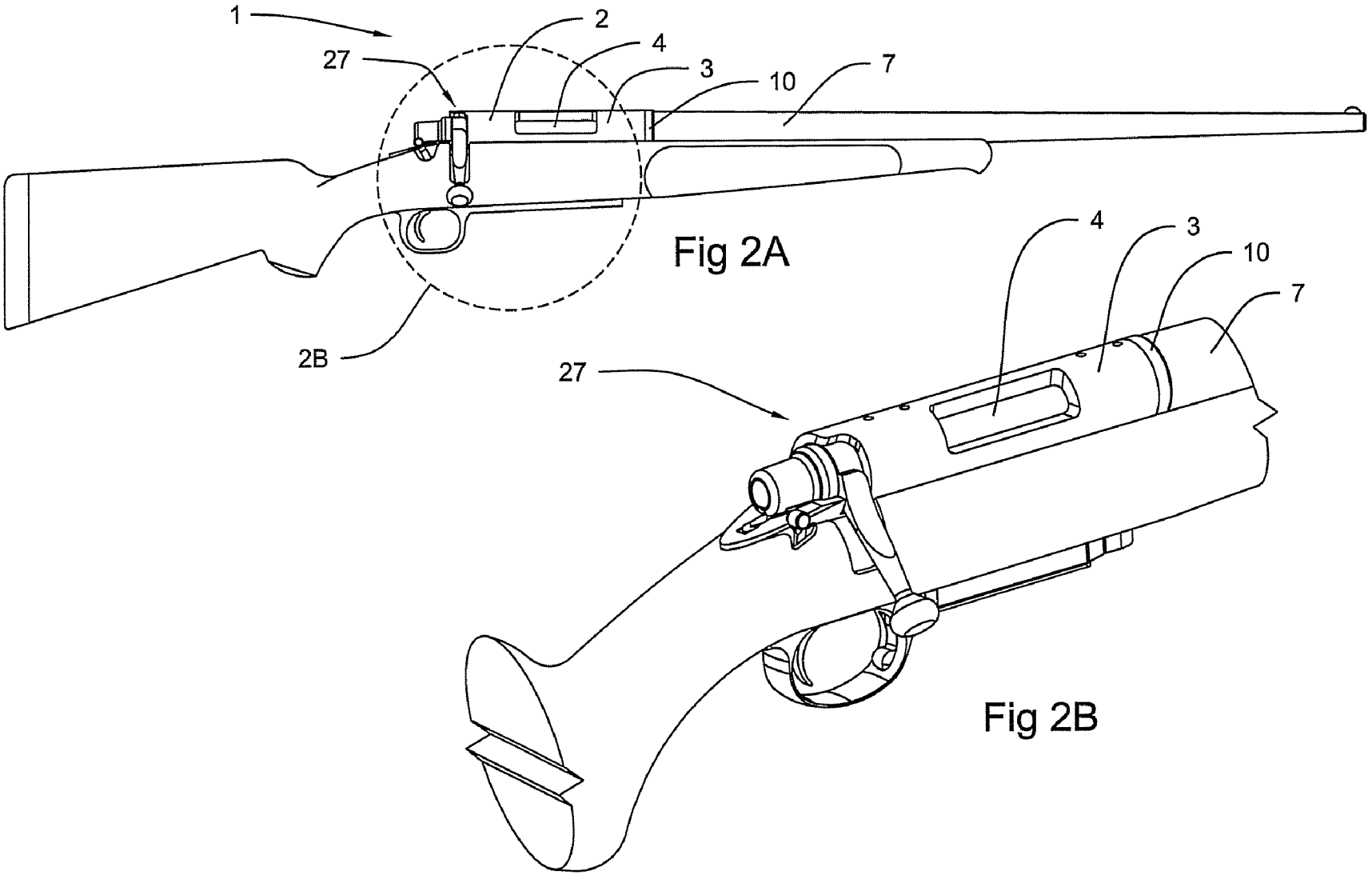
FIG. 2A is a side view of a bolt action rifle showing the bolt in the closed position.
FIG. 2B is an enlarged perspective view of the action of the rifle shown in FIG. 2A with the bolt in the closed position.
Figures 2C, 2D, 2E:
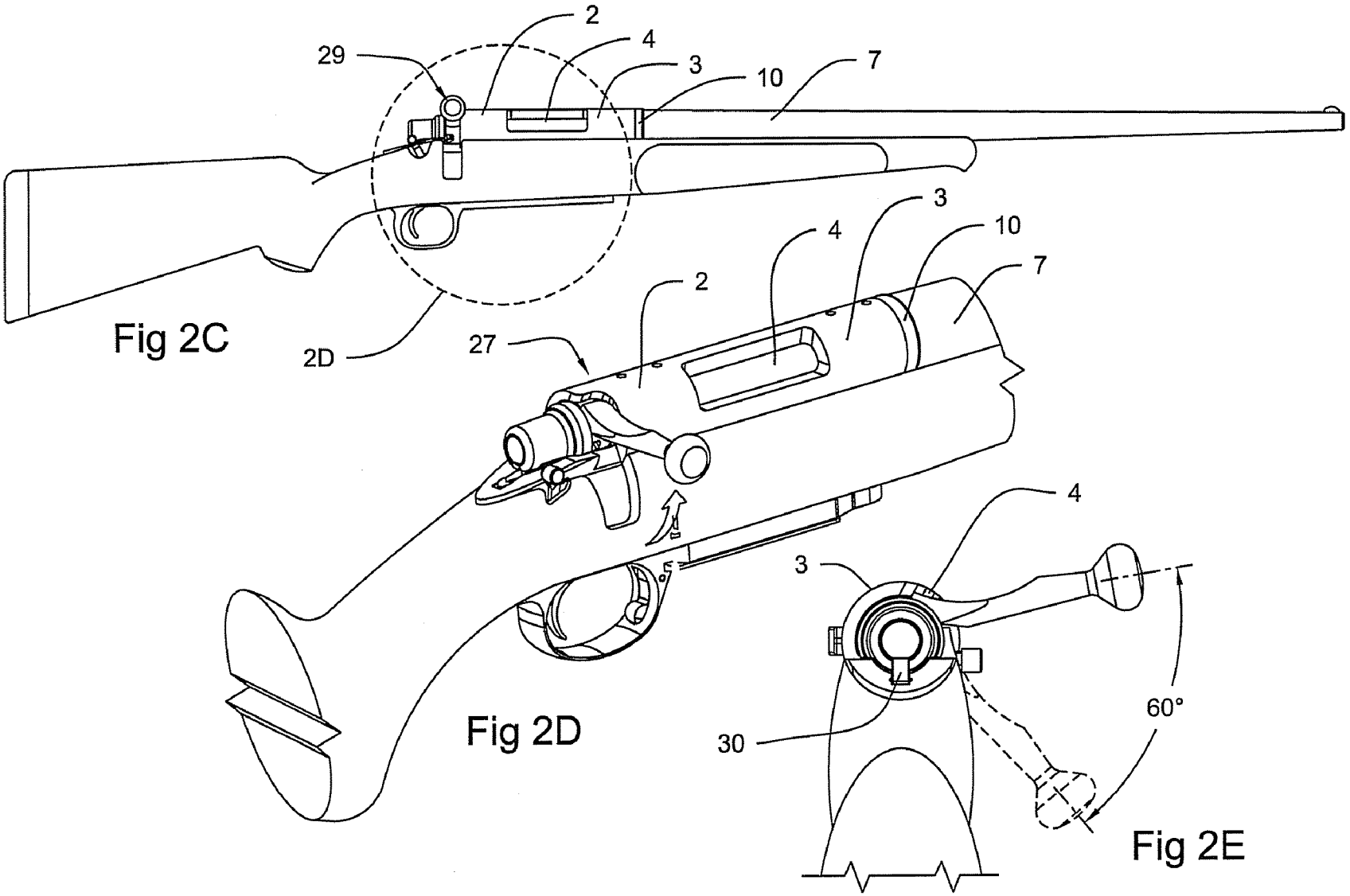
FIG. 2C is a side view of a bolt action rifle showing the bolt in the cocked position.
FIG. 2D is an enlarged perspective view of the action of the rifle shown in FIG. 2C with the bolt in the cocked position.
FIG. 2E is a cut-away end view of a bolt action rifle illustrating the range of rotational motion of the bolt between the closed position and the cocked position in an embodiment in which the bolt has a row of three locking lugs.
Figures 2F, 2G:
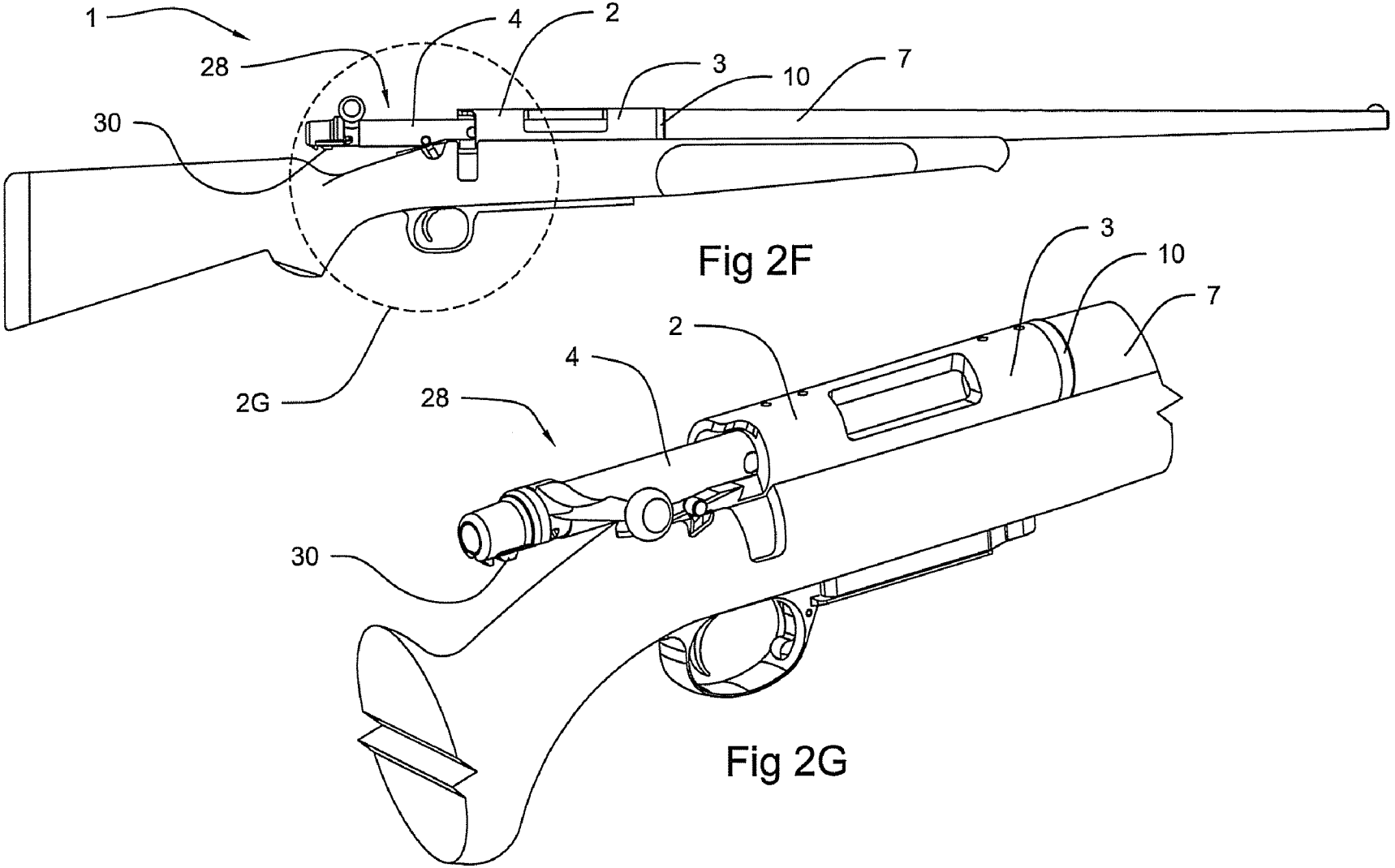
FIG. 2F is a side view of a bolt action rifle showing the bolt in the open position.
FIG. 2G is an enlarged perspective view of the action of the rifle shown in FIG. 2F with the bolt in the open position.
Figures 3A, 3B, 3C:
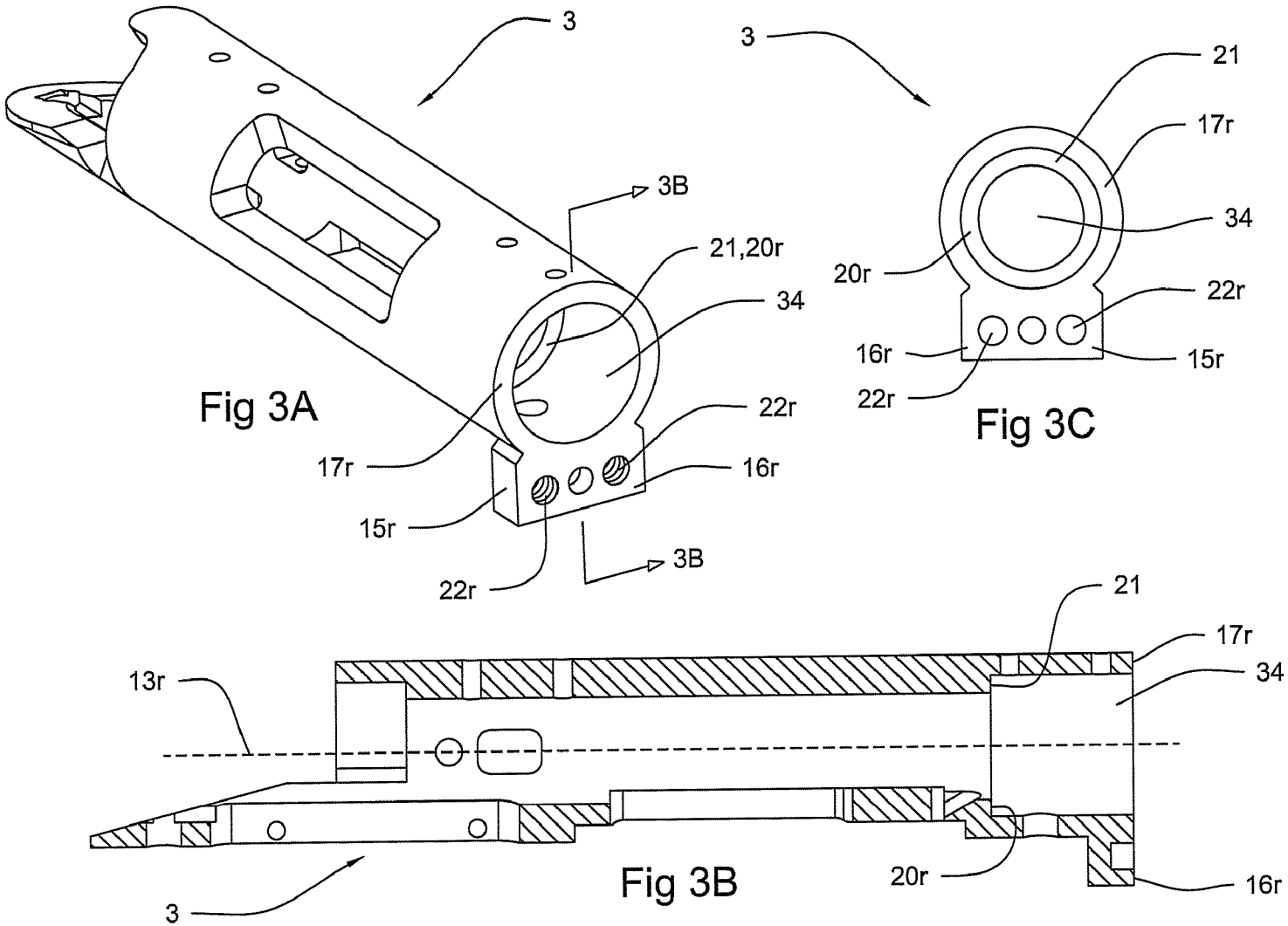
FIG. 3A is a perspective view of a preferred embodiment of the receiver.
FIG. 3B is a cut-away side view of a preferred embodiment of the receiver.
FIG. 3C is a front end view of a preferred embodiment of the receiver.

In a bolt action rifle 1, the action 2 includes a receiver 3. This is the portion of the action within which the bolt 4 slides. Receiver 3 has an open barrel end 34 opposite a stock end 35 and a longitudinal axis 13*r* extending therebetween. In bolt action rifles, bolt 4 is provided with two or more locking lugs 5. Lugs 5 are typically provided on the end of bolt 4 proximate to the chamber 6 of barrel 7, that is on the bolt head 8 opposite the handle end 36 of bolt 4 and proximate to the bolt face 14. In the prior art, bolt locking lugs 5 engage corresponding locking lugs 11 in receiver 3. The engagement of lugs 5, 11 holds bolt 4 in place adjacent to chamber 6 when bolt 4 is closed. Wear in locking lugs 11 is one of the major causes for headspace variation in rifles in the prior art.

In the present invention, receiver 3 contains no locking lugs 11. Rather, an insert 10 is provided which slips into the barrel end 34 of receiver 3. Insert 10 has a barrel end 10*b* and a receiver end 10*r*. Receiver 3 is inlet to allow insert 10 to be properly positioned in receiver 3. The interior of receiver 3 is preferably provided with a shoulder 21. Shoulder 21 has a face 20*r*. Face 20*r* should preferably be substantially perpendicular to axis 13*r* (discussed below) and most preferably as perpendicular to axis 13*r* as practicable. It is insert 10 (rather than receiver 3) that contains locking lugs 11 for engaging locking lugs 5 on bolt head 8 when bolt 4 is closed.

Insert 10 preferably includes interior threads 12. Interior threads 12 extend from barrel end 10*b* of insert 10 inward a sufficient distance to match the length of the external threads 37 on barrel 7. Barrel 7 is threaded into insert 10. Thus, insert 10 joins barrel 7 and receiver 3.

It will be appreciated that barrel 7, insert 10, bolt 4, and receiver 3 each have a longitudinal axis 13*b*, 13*i*, 13*t*, and 13*r*, respectively. Aligning these axes precisely is important to the accuracy of rifle 1. Because insert 10 and barrel 7 are threaded together, designing them to be co-axial is relatively straightforward. However, aligning the axes 13*b*, 13*i* of barrel 7 and insert 10 with the axis 13*r* of receiver 3 is more challenging.

The exterior dimensions of insert 10 should preferably be sized to closely match the interior dimensions of receiver 3. By sizing insert 10 appropriately, axis 13*i* and axis 13*r* can be approximately aligned. Although the tolerances between insert 10 and receiver 3 will be close, there must be some space between insert 10 and receiver 3 to allow insert 10 to slide in and out of receiver 3. This necessary space creates some play between insert 10 and receiver 3. As a result, the fit between insert 10 and receiver 3 cannot hold axis 13*r* in exact alignment with axes 13*i*, 13*b*.

Misalignment between receiver 3 and the barrel 7 can lead to numerous problems pertaining to the accuracy of the rifle. Bolt 4 travels within receiver 3. If receiver 3 is out of alignment with barrel 7, bolt 4 will approach chamber 6 at an angle. This angle may be very, very slight. However, any angle can result in the locking lugs 5, 11 on bolt head 8 and insert 10 not mating completely flush.

Locking lugs 5, 11 should preferably mate so that they are completely flush with one another and in complete contact. If there is space between locking lugs 5, 11, the pressures exerted on bolt 4 when a round is fired will force bolt 4 back until that space is closed. Where such spaces between locking lugs 5, 11 are uneven, this rearward motion can cause uneven wear of lugs 5, 11 and distortion of bolt 4, bolt head 8, and/or bolt face 14. Wear in locking lugs 5, 11 can adversely affect headspace. Distortion of bolt head 8 and/or bolt face 14 can result in the round entering chamber 6 at an angle. If the round is not completely aligned with chamber 6, the bullet will enter barrel 7 at an angle. Thus, rather than spinning about its axis, the bullet will wobble in flight, resulting in an eccentric flight path and a loss of accuracy that increases downrange.

Rearward motion of bolt 4 upon discharge of a round will cause an additional impact within the rifle when the lugs 5, 11 come into contact. This impact can effect the harmonics of barrel 7 in ways that can be difficult to predict, beyond the fact that such effects are generally negative with respect to accuracy.

Misalignment of receiver 3 and barrel 7 can also cause scope sights to be misaligned with barrel 7. Optical scope sights are commonly used in bolt action rifles. The scope is essentially a telescope containing cross hairs, with the object being to align the point of aim of the cross hairs with the point of impact of the bullet on a target. Typically, the scope is mounted to the rifle using rings that encircle the scope and that screw onto bases mounted on receiver 3. If receiver 3 and barrel 7 are not completely aligned, the line of sight through the scope will not be parallel to the line of flight of a bullet leaving barrel 7.

When receiver 3 and barrel 7 are aligned, the line of sight of one looking through the center of the scope will be in the same vertical plane as the line of flight of a bullet leaving barrel 7. Thus, all other things being equal, the point of aim and the point of impact should be horizontally aligned across the range of the rifle. However, if receiver 3 and barrel 7 are not aligned, the line of sight through a scope mounted to receiver 3 will be in a slightly different vertical plane than the line of flight of a bullet leaving barrel 7. Viewed from above, two dotted lines representing the line of sight through the scope and the line of flight of the bullet would resemble an X when barrel 7 and receiver 3 are not in alignment. Where these lines cross, the point of impact of the bullet and the location of the cross hairs will be horizontally aligned. However, downrange or up range from where the two lines intersect, the point of aim and the point of impact would diverge horizontally.

Thus, aligning the axis 13*r* of receiver 3 with the axes 13*b*, 13*i* of barrel 7 and insert 10 and maintaining that alignment is important. The inventors accomplish this in the preferred embodiment using recoil lugs 15*r*, 15*i*. Recoil lug 15*r* and receiver 3 are preferably machined from a single piece of metal, though recoil lug 15*r* could be welded to receiver 3 if desired. Receiver 3 is preferably made from 416 stainless steel heat treated to between 36 and 40 on the Rockwell C scale. Recoil lug 15*r* will preferably have a face 16*r*. Similarly, receiver 3 will have a face 17*r*. Face 16*r* and face 17*r* will be substantially co-planar and most preferably as close to co-planar as practicable. Face 16*r* of recoil lug 15*r* will also be substantially perpendicular to axis 13*r* of receiver 3. The engagement of recoil lugs 15*r*, 15*i* will be described in detail below.

The preferred embodiment of insert 10 will now be more fully described. Insert 10 is preferably comprised of a substantially cylindrical, substantially hollow body 18. Body 18 has an external diameter that will substantially match the internal diameter of receiver 3 proximate face 17*r* of receiver 3. As noted above, the external diameter of cylindrical body 18 of insert 10 is slightly smaller that the internal diameter of receiver 3. In the preferred embodiment, the external diameter of insert 10 will be, at most, about 0.001 inches less than the internal diameter of the corresponding portion of receiver 3 (i.e., between face 17*r* and face 20*r*, in the preferred embodiment). End 10*b* of insert 10 (the end proximate barrel 7) is preferably provided with a shoulder 19. Shoulder 19 preferably has an exterior diameter approximately equal to the exterior diameter of receiver 3. Shoulder 19 has a face 17*i* facing end 10*r* of insert 10 (the end distal from barrel 7). Face 17*i* should be substantially perpendicular to axis 13*i* of insert 10, and preferably as perpendicular to axis 13*i* as practicable. When insert 10 is in position inside receiver 3, face 17*i* of shoulder 19 should preferably be completely flush with face 17*r* of receiver 3—that is with contact between faces 17*r* and 17*i* across substantially the entire circumference of each.

End 10*r* of insert 10 also has a face 20*i*. Face 20*i* should be substantially perpendicular to axis 13*i* of insert 10, and preferably as perpendicular to axis 13*i* as practicable. Face 20*i* is configured to abut face 20*r* of shoulder 21 inside receiver 3. Faces 20*i* and 20*r* should both preferably be smooth and flat and in contact throughout substantially their entire circumferences when insert 10 is installed in receiver 3. Insert 10 is preferably sized so that faces 20*i* and 20*r* and faces 17*i* and 17*r* will each be in full contact with their respective counterparts when insert 10 is fully inserted into receiver 3.

Returning to recoil lugs 15*i*, 15*r*, insert 10 is preferably provided with a recoil lug 15*i* depending from shoulder 19. Recoil lug 15*i* will preferably have a face 16*i*. Face 16*i* and face 17*i* of shoulder 19 of insert 10 will be substantially co-planar and most preferably as close to co-planar as practicable. Face 16*i* will also be substantially perpendicular to axis 13*i* of insert 10. Because faces 16*i* and 17*i* are co-planar and because faces 16*r* and 17*r* are co-planar, faces 16*i* and 16*r* will abut when faces 17*i* and 17*r* meet. (All abutting faces described above 16*i*, 16*r*; 17*i*, 17*r*; and 20*i*, 20*r* should preferably be smooth and flat so that contact can be made across substantially all of each abutting face).

Faces 16*i* and 16*r* of recoil lugs 15*i*, 15*r* are each substantially perpendicular to the longitudinal axis 13*i*, 13*r* of their respective components. Faces 16*i* and 16*r* are also substantially smooth and flat such that when faces 16*i* and 16*r* abut, faces 16*i* and 16*r* effectively become co-planar. Because these faces 16*i*, 16*r* are perpendicular to axes 13*i*, 13*r*, when faces 16*i* and 16*r* meet and become co-planar, axes 13*i*, 13*r* will be aligned. Thus, recoil lugs 15*i*, 15*r* serve to align receiver 3 with insert 10 and barrel 7.

Recoil lugs 15*i*, 15*r* are preferably provided with a plurality of apertures 22*r*, 22*i*. In the preferred embodiment, apertures 22*r* are threaded and apertures 22*i* include a composite washer. Recoil lugs can be secured to one another by passing screws 23 through apertures 22*i* and threading screws 23 into apertures 22*r*. In the preferred embodiment there are two pairs of apertures 22*r*, 22*i* and one screw 23 for each pair. Screws 23 will preferably be tightened evenly but only slightly, preferably to about fifteen inch pounds of torque each.

Securing recoil lugs 15*r*, 15*i* to each other will secure the alignment of barrel 7 and insert 10 with receiver 3. Furthermore, it will be appreciated that very little stress will be exerted on the connection between recoil lugs 15*r*, 15*i* described above when a round is discharged in chamber 6 of the rifle. While there will certainly be tremendous force exerted on insert 10 and receiver 3 during firing, these forces should apply equally to receiver 3 and insert 10. As a result, they should not subject screws 23 to any substantial compression or shear forces. Accordingly, very little wear is anticipated between recoil lugs 15*r*, 15*i* over the life of the rifle.

Insert 10 is described above as being comprised of several different components, namely body 18, shoulder 19, recoil lug 15, and locking lugs 11. Though it would be possible to construct insert 10 from various components, in the preferred embodiment, insert 10 will be milled and/or cast from a single piece of metal such that the components listed above merely describe different sections of a unitary piece. Preferably, insert 10 is milled from 416 stainless steel. The insert is preferably machined and then heat treated to about 40-45 on the Rockwell C hardness scale.

Similarly, receiver 3 is described as comprising multiple components, namely receiver 3 and recoil lug 15*i*. Receiver 3 and recoil lug 15*i* may be machined of a single piece of steel, preferably 416 stainless. However, recoil lug 15*i* is not expected to be subject to any significant force during operation of rifle 1. Thus, construction of receiver 3 can be simplified by welding recoil lug 15*i* to receiver 3. When recoil lug 15*i* is welded to receiver 3, both components will preferably be 416 stainless. They will preferably be heat treated to 36-40 on the Rockwell C hardness scale. The combined receiver and recoil lug 3, 15*i* is then machined and preferably heat treated again to the same hardness to ensure that the machining has not altered the desired hardness of the piece.

As mentioned above, insert 10 includes locking lugs 11. Locking lugs 11 are preferably positioned at end 10*r* of insert 10. In bolt action rifles, there will be either two or three pairs of lugs 5, 11. There can be more by utilizing additional rows of lugs, but more than three lugs per row is impractical for reason that will be discussed in more detail below.

Lugs 5 are preferably annular shoulders that extend outward from bolt head 8—away from axis 13*r* when bolt 4 is in place within receiver 3. Lugs 11 are preferably annular shoulders that extend inwardly from insert 10—toward axis 13*i*. Lugs 11 have an engagement face 24*i* on the side of lugs 11 facing barrel 7. Lugs 5 have an engagement face 24*b* on the side of lugs 5 facing away from barrel 7. Engagement faces 24*i*, 24*b* should preferably be smooth and be provided with very slight reciprocal angles.

Lugs 11 define an aperture 25 leading to the interior of insert 10. Lugs 11 are preferably positioned approximately equidistant from each other around the perimeter of aperture 25. The spaces 26 between each lug 11 are sized to match lugs 5 on bolt head 8. By rotating bolt 4 so that lugs 5 are aligned with spaces 26, bolt head 8 can pass through aperture 25. In this position, bolt 4 can push a cartridge through aperture 25 and into chamber 6.

Once bolt 4 is extended, bolt 4 will be rotated—clockwise when viewed from the rear of the rifle for a right handed shooter. Rotating bolt 4 will take lugs 5 out of alignment with spaces 26 and will bring them into alignment with lugs 11. As bolt 4 is completely rotated into its fully closed position 27, lugs 5, 11 will contact each other and the slight reciprocal angle of each face 24*i*, 24*b* will advance bolt 4 slightly to its fully closed position 27. At this point, lugs 5, 11 will preferably be fully aligned and engagement faces 24*i*, 24*b* will preferably be in complete contact with each other across their surfaces. In this position, locking lugs 5, 11 will be fully engaged and they will prevent any rearward motion of bolt 4. In this position, bolt 4 is in the proper position to fire a round in chamber 6.

After the round in chamber 6 has been fired or if the shooter simply wishes to unload the rifle, bolt 4 will be rotated in the direction opposite the direction it was rotated during closing. When bolt 4 is fully rotated in this direction, lugs 11 will once again be aligned with spaces 26, which will allow bolt 4 to be retracted into its open position 28. As bolt 4 is retracted it will extract the spent casing or unfired round from chamber 6.

The cocking mechanism of bolt action rifles differs from that of many other types of rifles in that rotation of bolt 4 from fully closed position 27 to the cocked position 29 is what cocks the rifle. In any firearm with a bolt, such as an automatic or semi-automatic rifle or a bolt action rifle, the firing pin is contained within the bolt. The firing pin is mounted on a mainspring. Cocking the rifle involves compressing the mainspring. Pulling the trigger releases the mainspring which drives the firing pin out of a hole in the bolt face and into the primer in the base of the cartridge. This impact detonates the primer, which ignites the powder, discharging the round. In an automatic or semi-automatic rifle (collectively "autoloaders"), retracting the bolt is what cocks the rifle. In an autoloader, the shooter generally only has to cock the rifle once. Thereafter, the recoil forces and/or expanding gases generated by discharge of a round are what drive the bolt rearward and cock the firing pin for the next round. Because cocking these types of rifles does not depend upon the rotation of the bolt, very little rotation is needed to disengage the locking lugs of the bolt from those in the receiver.

In most bolt action rifles, once the firing pin has been released, it remains uncocked until the bolt is rotated from fully closed position 27 to cocked position 29. A cocking piece 30 is contained within bolt 4. The nose 31 of cocking piece 30 engages an angled surface 38 on bolt 4. As bolt 4 is rotated, angled surface 38 cams the cocking piece 30 back, compressing mainspring 32, and cocking the rifle.

It will be appreciated that the longer the distance over which bolt 4 may be rotated, the less force will be required of the shooter to effect the rotation. The amount of work will be the same, but the amount of force per degree of rotation will be less, the more degrees of rotation are available.

It will also be appreciated that the primary purpose of lugs 5,11 is to overlap in the fully closed position 27 to the greatest degree possible while still allowing for lugs 5, 11 to disengage in the cocked position 29. Thus, lugs 5 and lugs 11 can each encompass no more than one hundred eighty degrees of the exterior circumference of bolt head 8 or the interior circumference of insert 10 (or receiver 3 in the prior art). Therefore, in a two lug bolt, each lug 5 will span about ninety degrees of the exterior circumference of bolt head 8 and ninety degrees is the maximum amount of rotation possible between fully closed position 27 and cocked position 29. In a three lug bolt, each lug 5 will span about sixty degrees of the exterior circumference of bolt head 8 and sixty degrees is the maximum amount of rotation possible between fully closed position 27 and cocked position 29. Accordingly, a three lug bolt requires the shooter to cock mainspring 32 in two-thirds the distance of a two lug bolt, and the amount of force required of the shooter will be about ⅓ greater per degree of rotation in a three lug bolt than in a two lug bolt. If the number of lugs were increased beyond three, the available distance for cocking would shorten further and the force required would increase accordingly. The force needed to cock mainspring 32 over twenty-two and one half degrees will increase the force required of the shooter sufficiently to interfere with smooth handling of the rifle. As a result, four or more lugs 5 (per row) are generally not considered practical in a bolt action rifle.

As noted above, three lugs and rotation of the bolt over sixty degrees will require markedly more force per degree of rotation than a two lug bolt would require. To address this, the inventors contemplate using a variable rate spring 33 for mainspring 32. A variable rate spring is a spring whose stiffness increases with compression. In general, it will be easier for the shooter to begin rotation of bolt 4 if mainspring 32 is a variable rate spring 33. Of course, it will require more force to continue rotating bolt 4 as the rotation continues; however, bolt 4 will be in motion as the required force increases and the effect of momentum will facilitate both continued rotation of bolt 4 and the shooter's perception of the effort required to rotate bolt 4.

There are several ways to construct variable rate spring 33. The spring coil can be produced from tapered spring stock. Another option is to increase the diameter of each coil of the spring along the length of the spring, giving the spring a somewhat conical cross section, as opposed to the cylindrical cross section typical of springs of uniform coil diameter. Still another option is to vary the space between each coil, and of course two or more of these options could be used in combination. Generally speaking, making the spring stock thicker, increasing the diameter of the coils, and increasing the distance between each coil will make the spiring more difficult to compress.

The inventors' preferred source of variable rate spring 33 is the W.C. Wolf Company of Newtown Square, Pa. The preferred variable rate spring 33 is made of spring steel and preferably is a sixteen to thirty-three pound spring, meaning that it requires sixteen pounds of force commence compression of the spring but that as the spring is compressed further, the amount force required to continue compression increases to thirty-three pounds.

Describing the preferred embodiment in operation, insert 10 will be inserted into barrel end 34 of receiver 3. Face 17*i* of shoulder 19 of insert 10 will abut face 17*r* of receiver 3 and face 20*i* of end 10*r* of insert 10 will abut face 20*r* of shoulder 21 inside receiver 3. Faces 16*i* and 16*r* of recoil lugs 15*i*, 15*r* will also abut when insert 10 is installed in receiver 3. Insert 10 will be secured to receiver 3 using screws 23. Because faces 16*i* and 17*i* are perpendicular to axis 13*i* of insert 10 and faces 16*r* and 17*r* are perpendicular to axis 13*r* of receiver 3, when faces 16*i* and 17*i* abut faces 16*r* and 17*r*, axes 13*r* and 13*i* will be aligned and held in alignment by screws 23. Barrel 7 will be threaded into insert 10. Because barrel 7 is coaxial with body 18 of insert 10, axis 13*b* will be aligned with axes 13*i* and 13*r*. Lugs 11 in insert 10 will determine the position of bolt head 8 and bolt face 14 relative to chamber 6. Accordingly, headspace can be preset by matching barrel 7 and insert 10. This will greatly simplify changing barrel 7. If a new barrel 7 is to be added to rifle 1, the old barrel 7 may be removed by unscrewing the old barrel 7 from insert 10 and then removing insert 10 from receiver 3. A new insert 10, matched to a new barrel 7, may then be secured to receiver 3 with screws 23, and the new barrel 7 threaded onto the new insert 10. Because the new insert 10 and its lugs 11 will control the position of bolt head 8, headspace can be entirely preset at the factory. No hand reaming of the new chamber 6 is required.

In the preferred embodiment, bolt 4 will be provided with a removable bolt head 8. Removable bolt heads 8 are well known in the art, but using them in the combination with insert 10 and barrel 7 will greatly enhance the versatility of rifle 1. Bolt head 8 must match the diameter of the shell casing. Thus, using a single bolt head 8, one could start with a .243 Winchester and convert the rifle to a .308 Winchester or a .338 Federal or anything else in the .308 family, simply by changing barrel 7 and insert 10. However, if one wanted to convert the rifle to a .30-06 Springfield, the bolt head 8 would also need to be changed to accommodate cartridges in the .30-06 family. Accordingly, one could purchase a .243 Winchester and convert it to a .30-06 Springfield simply by changing barrel 7, insert 10, and bolt head 8.

Figures 4A, 4B, 4C, 4D, 4E:
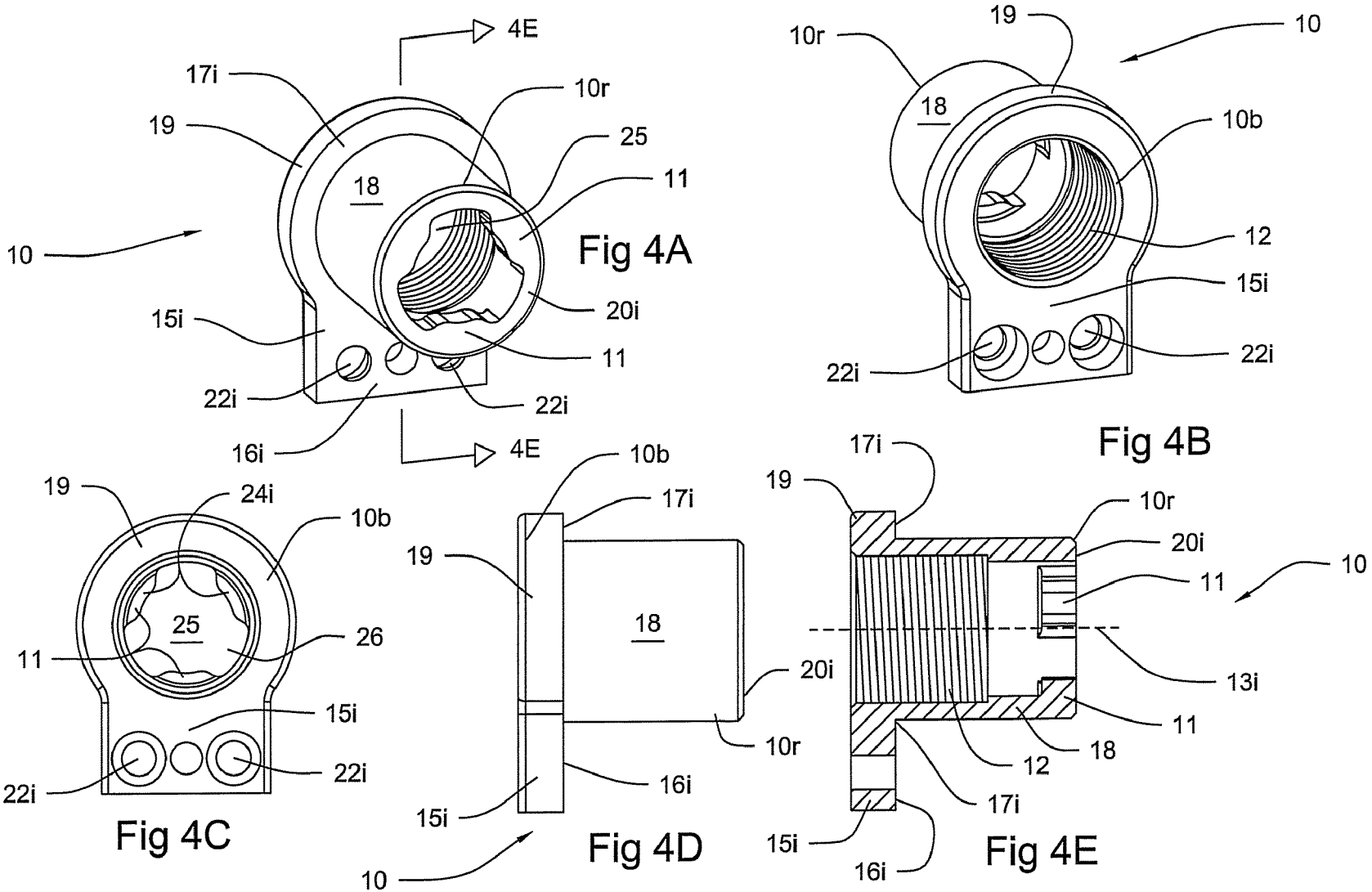
FIG. 4A is a perspective front view of a preferred embodiment of the insert.
FIG. 4B is a perspective rear view of a preferred embodiment of the insert.
FIG. 4C is an front end view of a preferred embodiment of the insert.
FIG. 4D is a rear end view of a preferred embodiment of the insert.
FIG. 4E is a cut-away side view of a preferred embodiment of the insert.
Figures 5A, 5B:
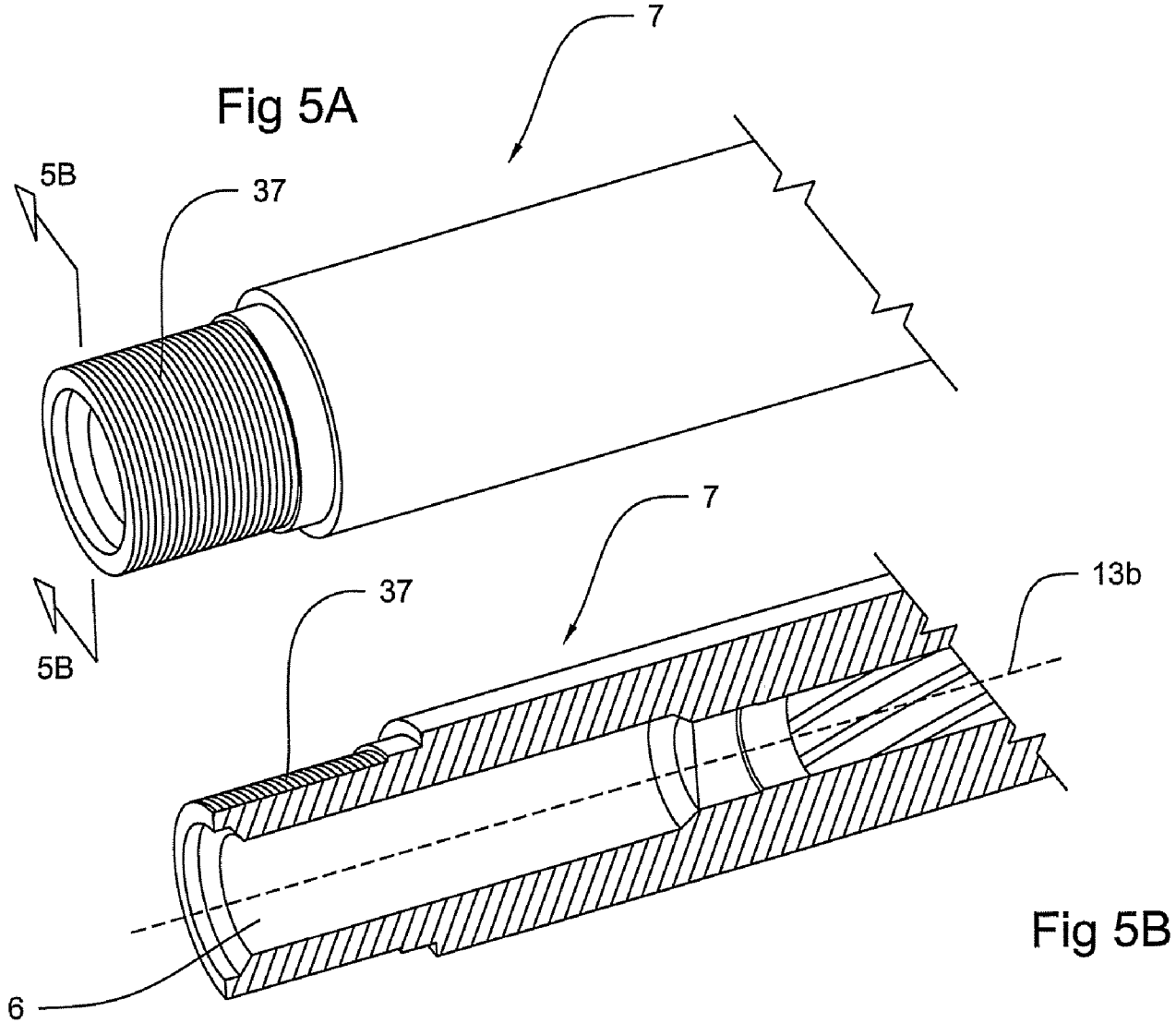
FIG. 5A is a perspective view of a preferred embodiment of a barrel.
FIG. 5B is a perspective cut-away view of a preferred embodiment of a barrel.
Figure 6A:
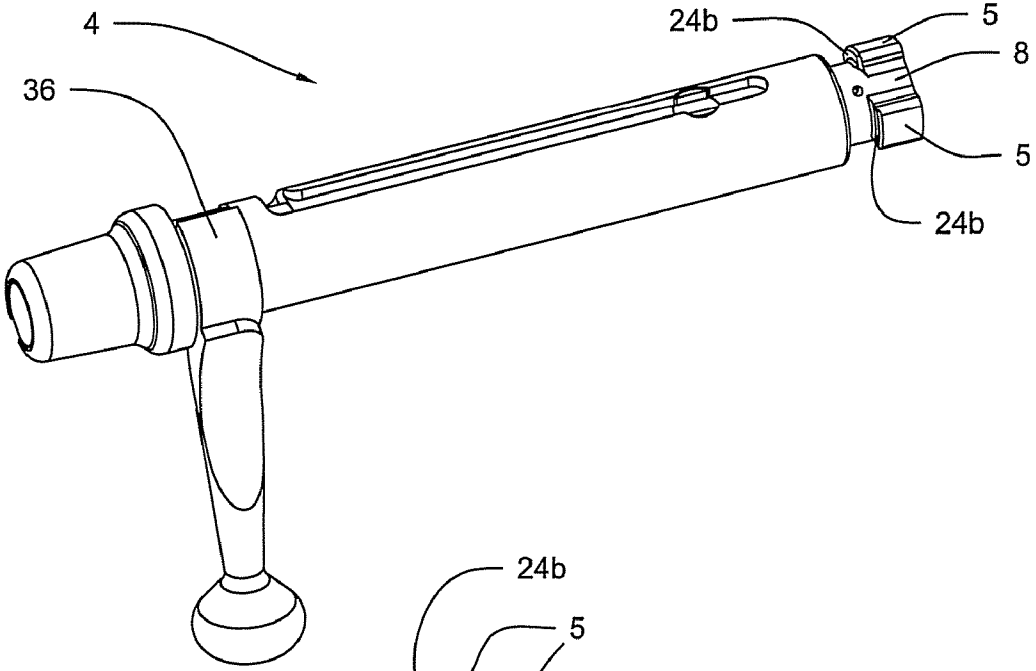
FIG. 6A is a top perspective view of a preferred embodiment of the bolt.
Figure 6B:
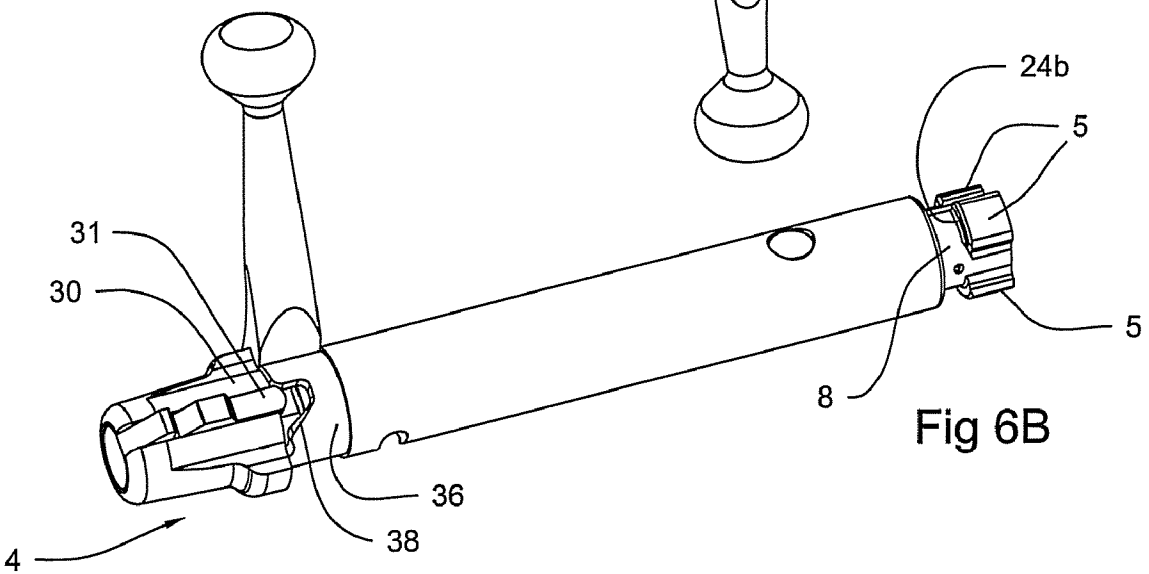
FIG. 6B is a bottom perspective view of a preferred embodiment of the bolt.
Figures 7, 7A:
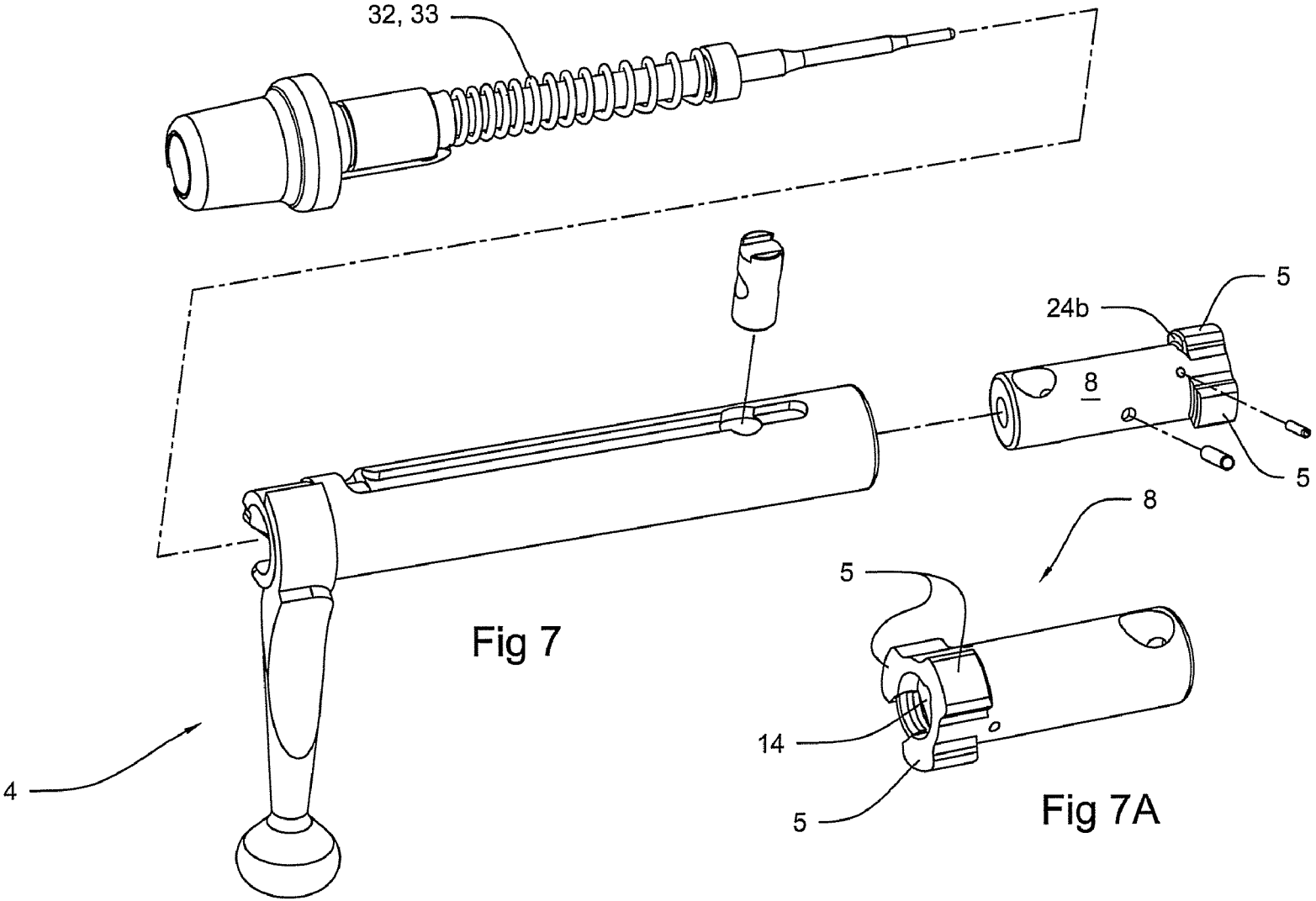
FIG. 7 is an exploded view of a preferred embodiment of the bolt.
FIG. 7A is a front perspective view of a preferred embodiment of the bolt head.
Figure 8:
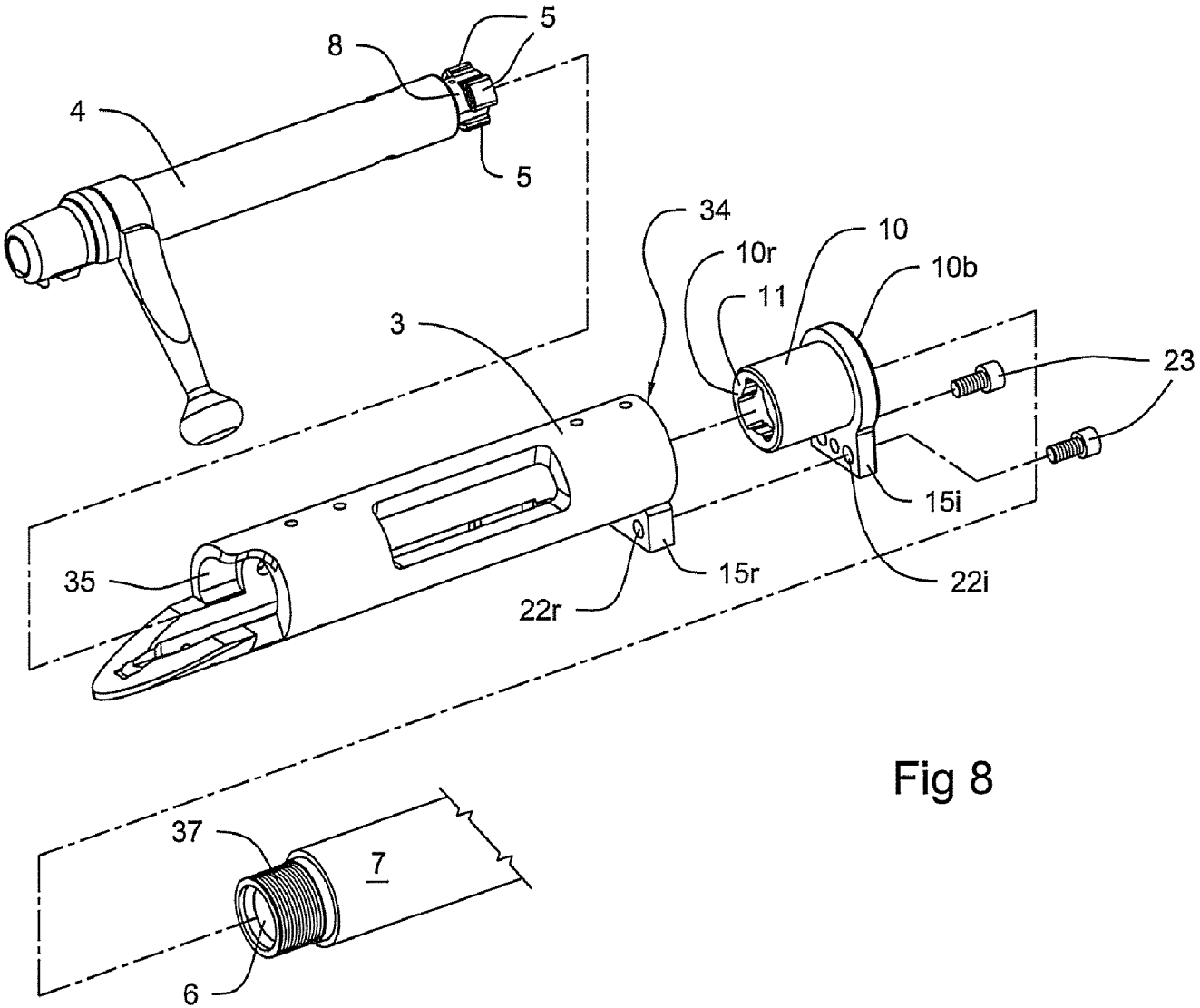
FIG. 8 is an exploded view of the preferred embodiment of the bolt, receiver, insert and barrel.
Figure 9A:
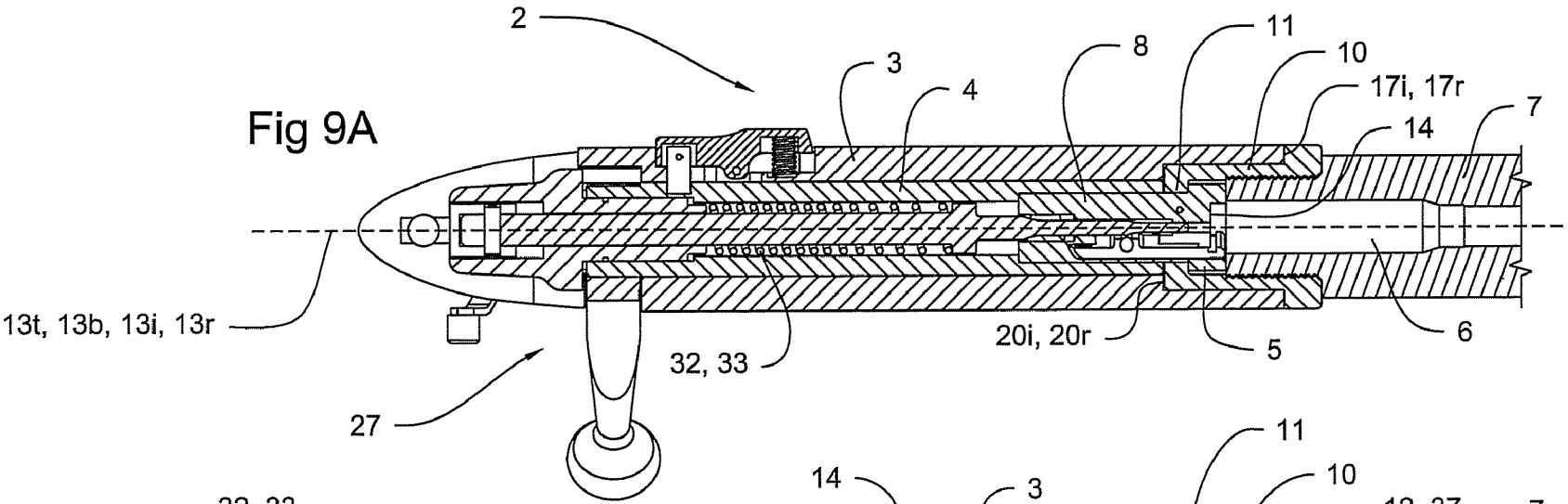
FIG. 9A is a cut-away top view of a preferred embodiment of the invention showing the bolt in the closed position.
Figure 9B:
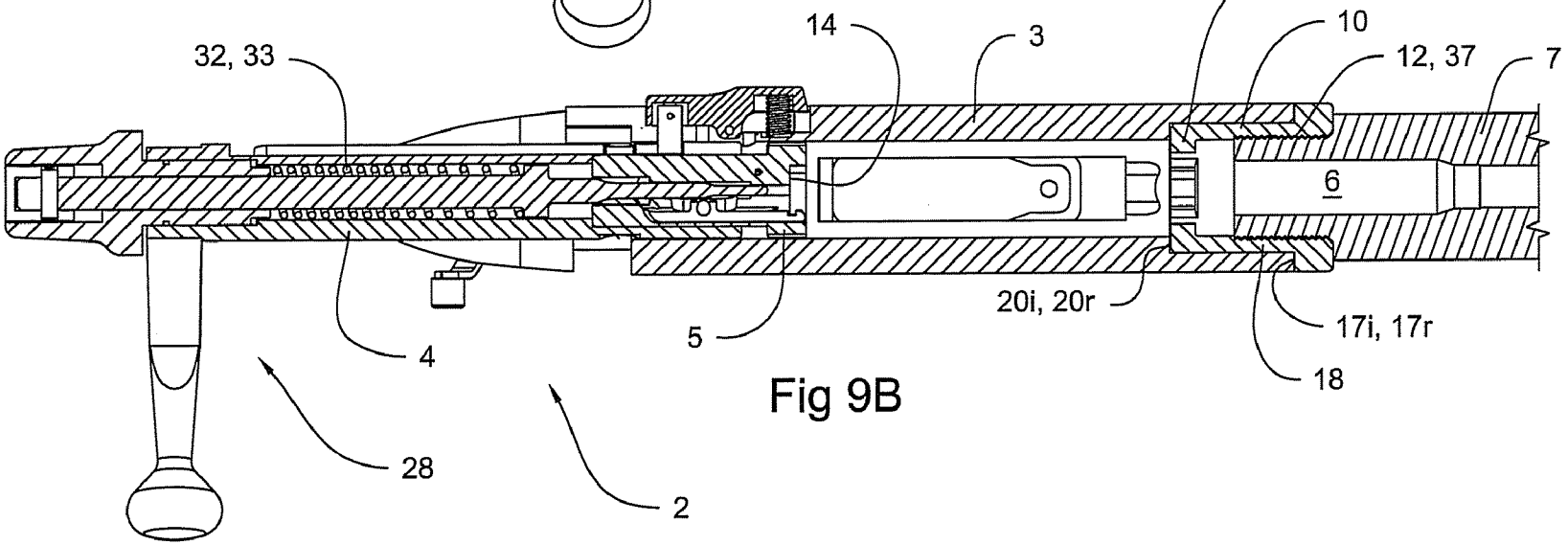
FIG. 9B is a cut-away top view of a preferred embodiment of the invention showing the bolt in the open position.
Figure 10A:
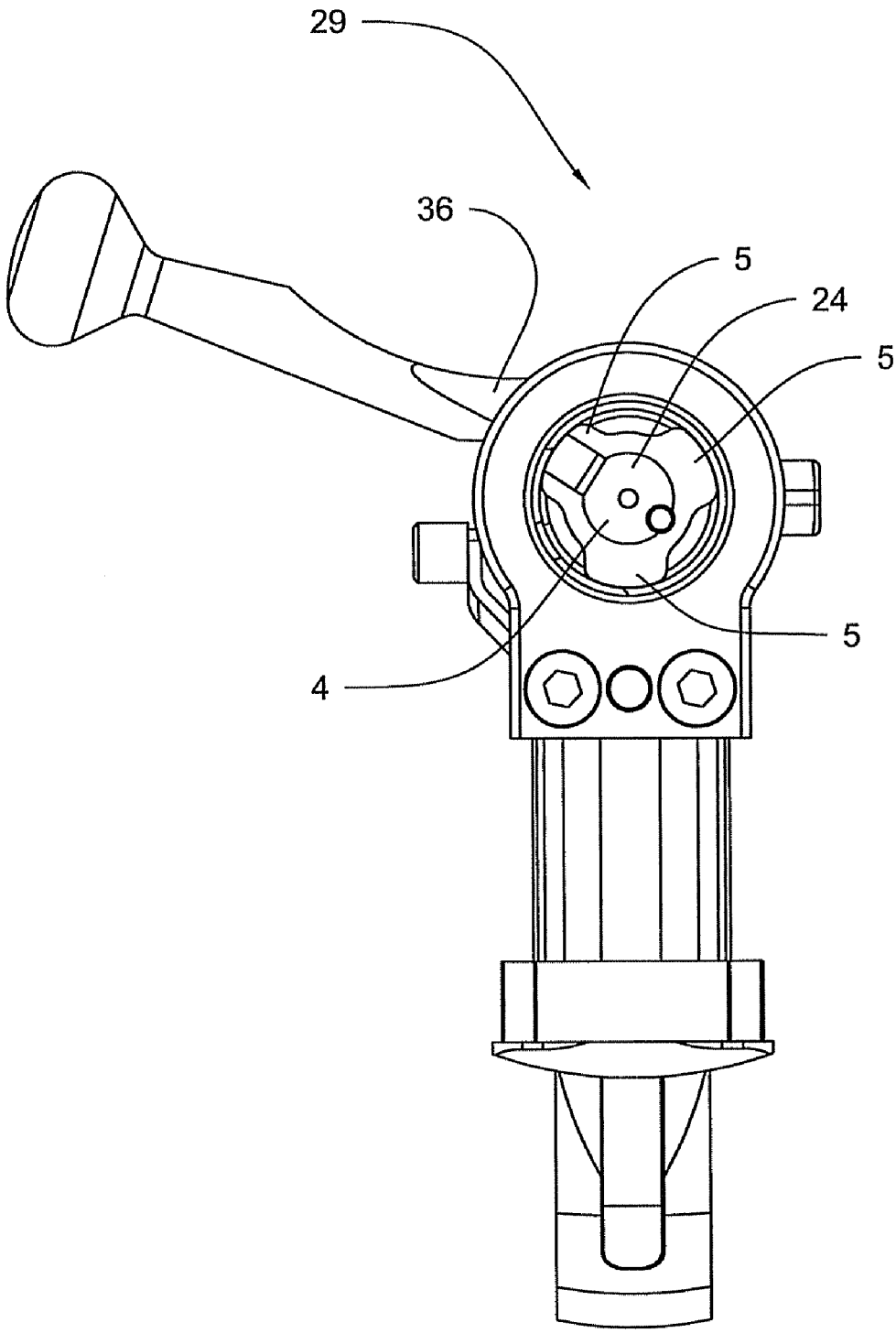
FIG. 10A is an end view illustrating a preferred embodiment of the bolt in the cocked position, wherein the locking lugs are in a 2-6-10 position.
Figure 10B:
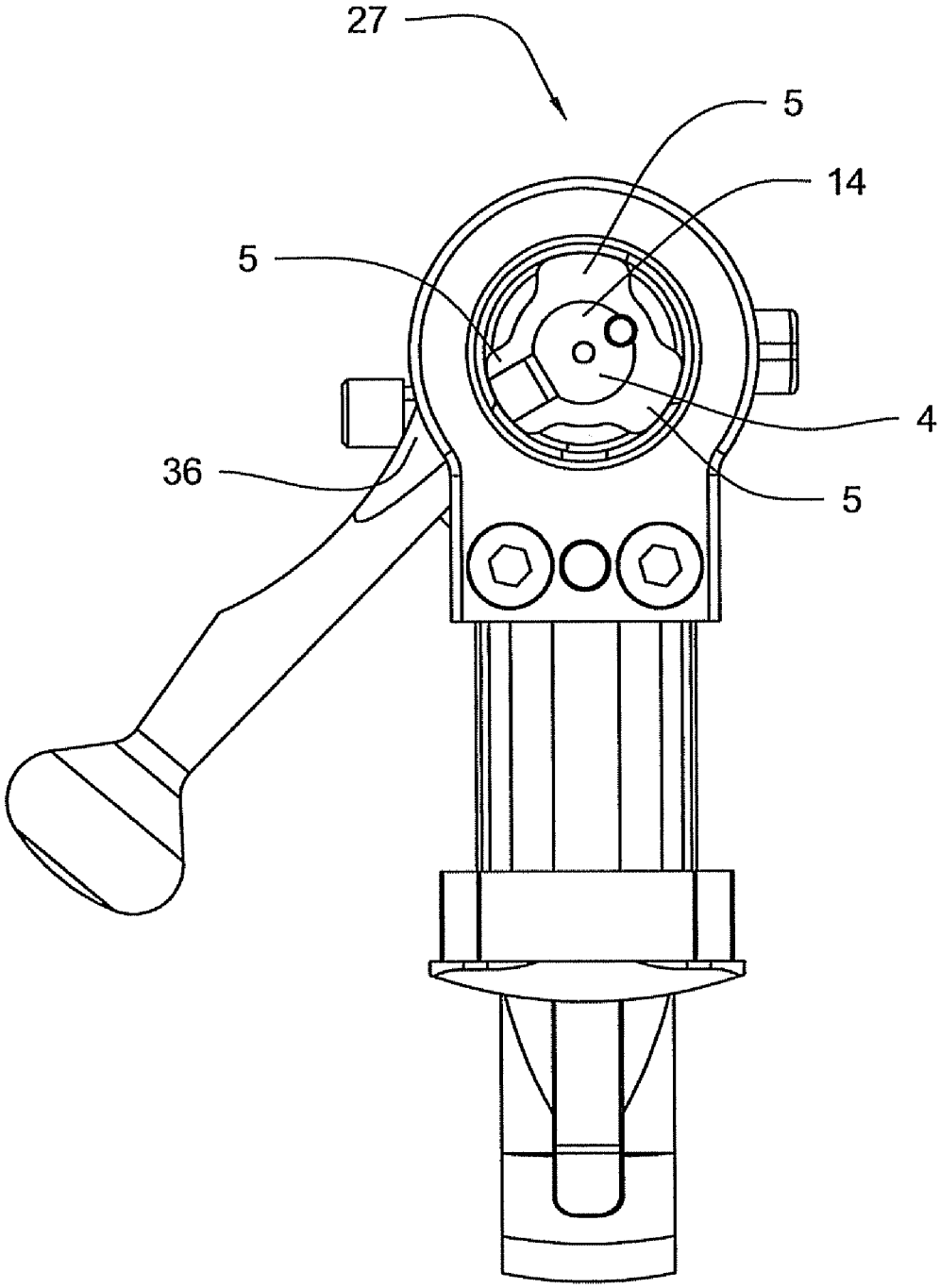
FIG. 10B is an end view of the bolt illustrated in FIG. 10A in the closed position.

In prior art three lug bolts, when bolt 4 is in cocked position 29, lugs 5 are typically positioned at approximately twelve o'clock, four o'clock and eight o'clock. In the above described embodiments of the present invention, insert 10 is configured to match, as illustrated in FIGS. 4A and 4C, wherein spaces 26 are positioned to correspond to lugs 5 when bolt 4 is in cocked position 29. However, it will be appreciated that in prior art three lug bolts, only the corners of lugs 5 engage a round when bolt 4 is feeding a new round into chamber 6 from the magazine of rifle 1. In one embodiment of the invention, the engagement between lugs 5 and the round is improved. In this embodiment, lugs 5 are positioned approximately two o'clock, six o'clock and ten o'clock when bolt 4 is in cocked position 29. This places the entire surface of one lug 5, or at least the entire lower portion of lug 5, in contact with a round in the rifle magazine when bolt 4 is pushing a new round out of the rifle magazine. This increases the amount of contact between the round and the lug significantly as compared to prior art three lug bolts, and in the inventors' experience, amounts to a significant improvement in the ability of bolt 4 to feed new rounds from the magazine into the chamber.

It should be noted that using a separate insert 10 and barrel 7 is a significant aspect of the invention. It would be conceivable to combine insert 10 and barrel 7 into a single piece. The barrel 7 would simply include the locking lugs 11 at an appropriate distance behind the chamber 6. The entire device could be externally threaded to mate with the receiver 3 or it could be secured to receiver 3 using screws or other standard attachment devices. This would convert a relationship among four pieces (bolt, receiver, insert and barrel) into a relationship among only three pieces (bolt, receiver, and barrel), simplifying the components that would need to be aligned. However, such an approach creates more problems than it solves and is potentially dangerous to the shooter.

Rifle barrels should be heat treated to about 28-32 on the Rockwell hardness scale. Barrels should not be much harder than this. Increased hardness equals increased brittleness. Soft metals can expand when exposed to excessive pressures. Very hard, brittle metals break when exposed to excessive pressures. A barrel should be able to expand if exposed to excessive pressures, which can arise in the event of a barrel blockage, such as mud or water becoming lodged in the barrel. If the barrel were to break, fragmentation can occur—effectively shrapnel exploding in the vicinity of the shooter. Alternatively, hard, brittle barrels can crack if exposed to excessive pressures. These cracks can allow gas to escape, again with potentially injurious consequences to the shooter. Thus, the barrel needs to be relatively soft. However, lugs 5, 11 need to be very hard. Failure of the rifle in the vicinity of lugs 5, 11 is a concern, but it is addressed by the much thicker steel walls surrounding chamber 6. What is particularly important with respect to lugs 5, 11 is that wear be minimized. As discussed at length above, the relationship between lugs 5, 11 determine headspacing. If lugs 11 wear, the headspacing can get out of specification, which can lead to numerous problems including catastrophic failure of the rifle. Because of this, lugs 11 need to be heat treated to a hardness of between the high 40's to the low 50's on the Rockwell hardness scale. Making barrel 7 and insert 10 of one piece would require the lugs portion of insert 10 to be one hardness and rest of the barrel to be another significantly different hardness. While this may be possible, it would undoubtedly be difficult, expensive and time consuming. Thus, there are significant advantages to making insert 10 a separate piece from barrel 7.

These and other modifications for a bolt action rifle will be apparent to those of skill in the art from the foregoing disclosure and drawings and are intended to be encompassed by the scope and spirit of the following claims.

We claim:

1. An improved system for joining a barrel to the receiver of a bolt action rifle comprising a substantially hollow receiver having a stock end opposite an open barrel end and a longitudinal axis extending therebetween;

a barrel having an externally threaded chamber end and a muzzle end and a longitudinal axis extending therebetween, said chamber end containing a chamber configured to receive a rifle cartridge;

an insert having a barrel end and a receiver end and a substantially cylindrical passageway extending therebetween; said substantially cylindrical passageway having a longitudinal axis extending from said barrel end to said receiver end, said substantially cylindrical passageway further comprising a plurality of internal threads in threaded engagement with said external threads on said chamber end of said barrel and wherein said receiver end of said insert is releasably disposed in said barrel end of said receiver, and wherein said insert is configured to align said longitudinal axis of said barrel with said longitudinal axis of said receiver and with said longitudinal axis of said passageway through said insert, whereby said barrel, said passageway and said receiver are rendered substantially coaxial, and wherein said insert further comprises a plurality of annular locking lugs extending into said passageway proximate to said receiver end of said insert, said insert lugs defining a plurality of lug spaces positioned between said lugs; and a bolt having a handle end and a bolt head opposite said handle end, said bolt slidably and rotatably disposed within said receiver and oriented with said bolt head facing said barrel end of said receiver, said bolt head further comprising a bolt face positioned substantially transverse to said common longitudinal axis of said receiver, said passageway and said barrel; said bolt head having a plurality of annular locking lugs extending outward from said bolt head, wherein said bolt locking lugs substantially match both said insert locking lugs and said insert lug spaces;

said bolt having an open position wherein said bolt is oriented so that said bolt locking lugs are aligned with said insert lug spaces, whereby said bolt face and said bolt locking lugs may be advanced into said substantially cylindrical passageway of said insert by sliding said bolt toward said barrel end of said receiver;

said bolt having a closed position wherein said locking lugs of said bolt are between said locking lugs of said insert and said barrel end of said insert, and wherein said locking lugs of said bolt and said locking lugs of said insert are substantially aligned and in substantial contact, whereby said locking lugs of said insert will prevent substantially any motion by said bolt toward said stock end of said receiver, and wherein said bolt may be moved into said fully closed position from said open position by completely advancing said bolt toward said barrel end of said receiver and then rotating said bolt;

wherein said insert locking lugs are configured to engage said bolt locking lugs as said bolt is rotated into said closed position and wherein said insert locking lugs and said insert are sized and positioned to move said bolt face to within a predetermined distance from said chamber as said insert locking lugs engage said bolt locking lugs during rotation of said bolt into said closed position; and a first recoil lug depending from said receiver and a second recoil lug depending from said insert, wherein said first recoil lug is positioned substantially perpendicular to said longitudinal axis of said receiver and said second recoil lug is positioned substantially perpendicular to said longitudinal axis of said substantially cylindrical passageway of said insert; whereby securing said first recoil lug in a position substantially parallel to said second recoil lug will substantially align said longitudinal axis of said receiver with said longitudinal axis of said substantially cylindrical passageway.

2. An improved system for joining a barrel to the receiver of a bolt action rifle according to claim 1 wherein said bolt has not more than three locking lugs.

3. An improved system for joining a barrel to the receiver of a bolt action rifle according to claim 2 wherein said insert has not more than three locking lugs.

4. An improved system for joining a barrel to the receiver of a bolt action rifle according to claim 1 wherein said first recoil lug and said second recoil lug are releasably secured to each other.

5. An improved system for joining a barrel to the receiver of a bolt action rifle according to claim 1 wherein said bolt and said insert each have three locking lugs.

6. An improved system for joining a barrel to the receiver of a bolt action rifle according to claim 5 wherein said bolt contains a firing pin mounted on a mainspring.

7. An improved system for joining a barrel to the receiver of a bolt action rifle according to claim 6 wherein said bolt is configured to cock said mainspring by rotating said bolt about sixty degrees from of said closed position into a cocked position.

8. An improved system for joining a barrel to the receiver of a bolt action rifle according to claim 7 wherein said mainspring comprises a variable rate spring.

9. An improved system for joining a barrel to the receiver of a bolt action rifle according to claim 1 wherein said bolt head is releasable.

10. A replacement barrel set for a bolt action rifle comprising a substantially hollow receiver having a longitudinal axis, a bolt slidably disposed within the receiver and having a face and a plurality of locking lugs radially disposed on the bolt about the bolt face wherein the replacement barrel set comprises:

a barrel having an externally threaded chamber end opposite a muzzle end and a longitudinal axis extending therebetween, said chamber end containing a chamber having dimensions configured to receive a rifle cartridge of a preselected caliber and wherein selection of caliber requires the chamber to have an appropriate headspace as measured by the dimensions of the chamber relative to the face of the bolt;

an insert comprising a barrel end and a receiver end and a substantially cylindrical passageway extending therebetween; said substantially cylindrical passageway having a longitudinal axis extending from said barrel end to said receiver end, said substantially cylindrical passageway further comprising a plurality of internal threads configured to threadedly engage said external threads on said chamber end of said barrel, wherein said insert and said threads are configured to substantially align said longitudinal axis of said insert with said longitudinal axis of said barrel when said external threads of said barrel are in engagement with said internal threads of said insert, said insert further comprising a plurality of annular locking lugs extending into said passageway proximate to said receiver end of said insert, said insert lugs defining a plurality of lug spaces positioned between said lugs;

wherein said insert is sized and configured to be inserted into said receiver, said insert further sized and configured to substantially align said longitudinal axes of said insert and said barrel with said longitudinal axis of said receiver when said insert is fully inserted into said receiver;

wherein said plurality of lug spaces are sized to allow said locking lugs on said bolt to pass through said spaces when said insert is fully inserted into said receiver and when said bolt is rotated to align said bolt locking lugs with said spaces;

wherein said plurality of lugs on said insert are sized and positioned to engage said locking lugs on said bolt when said insert is fully inserted into said receiver, said bolt has been advanced to pass said locking lugs of said bolt through said spaces, and said bolt has been rotated to take said locking lugs of said bolt out of alignment with said spaces, said plurality of lugs on said insert further configured to prevent said bolt from retracting when said lugs on said insert and said lugs on bolt are engaged;

wherein said plurality of lugs on said insert are sized and positioned relative to said chamber to position said bolt face at an appropriate position relative to said chamber to ensure that said headspace is proper for said selected caliber when said plurality of lugs on said insert and said plurality of lugs on said bolt are engaged; and wherein said receiver is further provided with a first recoil lug depending from said receiver and positioned substantially perpendicular to said longitudinal axis of said receiver and wherein said insert further comprises a second recoil lug depending from said insert and positioned substantially perpendicular to said longitudinal axis of said substantially cylindrical passageway of said insert; whereby securing said first recoil lug in a position substantially parallel to said second recoil lug will substantially align said longitudinal axis of said receiver with said longitudinal axis of said substantially cylindrical passageway.

11. A replacement barrel set according to claim 10 wherein said bolt has not more than three locking lugs.

12. A replacement barrel set according to claim 11 wherein said insert has not more than three locking lugs.

13. A replacement barrel set according to claim 10 wherein said first recoil lug and said second recoil lug are configured to releasably engage each other.

14. A replacement barrel set according to claim 13 wherein said bolt and said insert each have three locking lugs.

15. An improved bolt for a bolt action rifle having a receiver, a barrel extending from said receiver, a magazine depending from said receiver and a bolt slidably disposed in said receiver, said bolt comprising an elongated body having a longitudinal axis, a face end proximate said barrel, and a handle end opposite said face end;

a first set of three lugs extending from said bolt proximate to said face end and substantially perpendicular to said longitudinal axis, said first set of lugs configured to correspond to a second set of lugs within said receiver, whereby alignment of said first said of lugs with said second set of lugs will prevent said bolt from advancing or retracting beyond said second set of lugs, said bolt having a closed position wherein said first set of lugs and said second set of lugs are substantially aligned and a cocked position wherein said first set of lugs and said second set of lugs are positioned so that there is no overlap between said first set of lugs and said second set of lugs, said bolt being configured to rotate between said closed position and said cocked position; and wherein said first set of lugs are positioned so that one of said lugs extends directly toward and is aligned with said magazine when said bold is in said cocked position.

16. An improved bolt for a bolt action rifle according to claim 15 wherein said first set of three lugs are substantially equally separated around said bolt face.

17. An improved bolt for a bolt action rifle according to claim 16 wherein said first set of three lugs are substantially equal in size.

18. An improved bolt for a bolt action rifle according to claim 17 wherein said first set of three lugs each encompass about sixty degrees of the diameter of said bolt and wherein each of said first set of lugs are separated from each other by about sixty degrees.

* * * * *